US006083872A

United States Patent [19]

Adkins

[11] Patent Number: 6,083,872

[45] Date of Patent: Jul. 4, 2000

[54] PROTECTIVE OVERLAYS FOR THERMAL DYE TRANSFER PRINTS

[75] Inventor: Kelvin P Adkins, Essex, United Kingdom

[73] Assignee: Imperial Chemical Industries PLC, London, United Kingdom

[21] Appl. No.: 09/242,411

[22] PCT Filed: Aug. 14, 1997

[86] PCT No.: PCT/GB97/02185

§ 371 Date: Feb. 16, 1999

§ 102(e) Date: Feb. 16, 1999

[87] PCT Pub. No.: WO98/07578

PCT Pub. Date: Feb. 26, 1998

[30] Foreign Application Priority Data

Aug. 16, 1996 [GB] United Kingdom ..... 9617285

[51] Int. Cl.[7] ..... B41M 5/035; B41M 5/38

[52] U.S. Cl. ..... 503/227; 428/195; 428/206; 428/207; 428/328; 428/403; 428/913; 428/914

[58] Field of Search ..... 8/471; 428/206, 428/207, 323, 328, 403, 913, 914, 195; 503/227

[56] References Cited

U.S. PATENT DOCUMENTS 5,932,309 8/1999 Smith et al. ..... 428/46

*Primary Examiner*—Bruce H. Hess
*Attorney, Agent, or Firm*—Pillsbury Madison & Sutro LLP

[57] ABSTRACT

A transfer foil comprising a carrier sheet and a thermally transferable overlay, the overlay comprising a transparent film of polymeric material having dispersed therein surface-stabiiised titanium dioxide, wherein the titanium dioxide is stabilised by coating the surface with alumina, silica or zirconia or mixtures thereof.

A thermal transfer dye sheet ribbon comprising a substrate supporting different coloured dyecoats provided as discrete uniform print-size panels arranged in a repeated sequence along the ribbon, and a thermally transferable overlay comprising a transparent film of polymeric material having dispersed therein surface-stabilised titanium dioxide, positioned between each repeated sequence of the dyecoat panels, wherein the titanium dioxide is stabilised by coating the surface with alumina, silica or zirconia or mixtures thereof.

10 Claims, No Drawings

PROTECTIVE OVERLAYS FOR THERMAL DYE TRANSFER PRINTS

This application is the national phase of international application PCT/GB97/02185 filed Aug. 14, 1997 which designated the U.S.

This invention relates to protective overlays for printed matter and in particular to such overlays for use with printed matter produced by thermal transfer printing.

Thermal transfer printing is a process in which one or more thermally transferable dyes are caused to transfer from selected areas of a dyesheet to a receiver by thermal stimuli, thereby to form an image. Using a dyesheet comprising a thin substrate supporting a dyecoat containing one or more uniformly spread dyes, printing is effected by heating selected discrete areas of the dyesheet while the dyecoat is pressed against a dye-receptive surface of a receiver sheet, thereby causing dye to transfer to corresponding areas of the receiver. The shape of the image transferred is determined by the number and locations of the discrete areas which are subjected to heating. Full colour prints can be produced by printing with different coloured dyecoats sequentially in like manner, and the different coloured dyecoats are usually provided as discrete uniform panels arranged in a repeated sequence along a ribbon-shaped dyesheet. High resolution photograph-like prints can be produced by thermal transfer printing using appropriate printing equipment, such as a programmable thermal print head or laser printer, controlled by electronic signals derived from a video, computer, electronic still camera, or similar signal generating apparatus. A typical thermal print head has a row of tiny selectively energizable heaters, spaced to print six or more pixels per miilimetre, often with two heaters per pixel. Laser printers require absorbers to convert the laser radiation to heat, usually in or under the dyecoat, and similarly produce the print by transferring dyes to the receiver pixel by pixel. The transfer mechanism is believed to depend very much on the conditions under which printing is carried out. Thus for example, when using a thermal head, the dyesheet and receiver are pressed together between the head and a platen roller, giving conditions favouring diffusion of the dyes from the dyesheet directly into the receiver, virtually precluding any sublimation. Where a small gap is provided between the dyesheet and receiver, as favoured in some laser driven printers for example, the transfer mechanism appears to be exclusively sublimation. However, in both cases the dyes are mobile molecules which can diffuse into and out of the receiver when warmed, or in the presence of various lyophilic liquids. In particular, grease from a finger holding a print can lead to migration of the dye to the surface, making the print seem dirty or causing smearing of the dyes, and plasticisers in plastic pouches can cause havoc with unprotected D2T2 images. Particularly bad in this respect is dioctylphthalate, used as a plasticiser in polyvinyl chloride from which such pouches are commonly made. For many years various protective covers have been proposed to protect thermal transfer prints against such effects as well as against abrasion.

In addition to the plasticiser type effects, thermal transfer prints are liable to be affected by exposure to uv radiation as present for example in sunlight.

US Pat. No. 4522881 discloses a protective overlay of 10 μm thickness consisting of a polyester resin containing organic uv absorbers such as benzophenones and benzotriazoles in an amount of 0.2% by weight. However, a 10 μm thick overlay can, when applied, have edge problems, ie the edges can be jagged due to incomplete cut-through and/or incomplete adhesion and ideally, the overlay should have a thickness of 2 to 5 μm. To achieve the same degree of uv absorbency, such thin overlays must contain a much greater quantity of the absorber and it has been found that at such quantity there is a deleterious effect on the property of the overlay as a barrier to plasticisers. Moreover, such UV absorbers are known to be prone to loss due to photochemical consumption and can crystallise out resulting in migration to the surface causing an undesirable blooming effect.

According to one aspect of the invention there is provided a protective overlay comprising a transparent film of polymeric material having dispersed therein zinc oxide or surface stabilised titanium dioxide.

The stabilisation of the surface of the titanium dioxide is important because the absorbance of uv radiation results in the formation on the surface of the particles of trivalent titanium ions linked to hydroxyl radicals which can further react to form highly reactive species which have an adverse effect on the photo-oxidative stability of the dyes in the printed image.

The surface stabilisation may be carried out by any of the means well known in the art such as coating with alumina, silica or zirconium or mixtures thereof.

According to a preferred aspect of the invention, the polymeric material has a Tg of between 50 and 200° C.

Polyesters and acrylic polymers are particularly suitable as are the polymers disclosed in WO-A- 96/14993 as overcoming the problem of microscopic cracks being formed in the overlay by excessive flexing of the print on which it is mounted.

The zinc oxide or titanium dioxide is preferably present in an amount of 1 to 400%, more preferably 25 to 100%, on weight of binder resin.

The overlay may have a thickness of 0.1 to 25 μm, preferably 1 to 5 μm.

Such a thin overlay is difficult to handle without some form of support. The overlay is, therefore, preferably mounted on a temporary carrier sheet to form a transfer foil. The carrier sheet is placed over the print and heat and pressure are applied to the sheet, for example by means of a hot roll laminator or a thermal head, to cause the overlay to adhere to the print. The transfer can be effected simultaneously over the whole print, and the carrier is then removed after the transfer is complete. Alternatively, transfer may be progressive, e.g. using heated rollers or a thermal head to transfer the topcoat line by line, and it is then generally more convenient to remove the carrier progressively as it emerges from the rolls or thermal head.

According to a further aspect of the invention, there is provided a transfer foil comprising a carrier sheet and a thermally transferable overlay, the overlay comprising a transparent film of polymeric material having dispersed therein zinc oxide or surface stabilised titanium dioxide.

The carrier sheet must be formed of material able to withstand the transfer temperatures. Paper can be used, but the thicker the sheet, the more transfer energy is required, and polymer films, such as PET film, typically less than 30 μm thick according to the manner in which the barrier composition is to be transferred is preferred. A carrier sheet of about 12 μm thickness is suitable when using a hot roller laminator unit, but a heat-resistant back-coated film of 5–7 μm thickness is preferred when using a thermal head. To assist in release of the cover material from a thermoplastic carrier sheet, the latter may be primed with a cross-linked resin, to prevent fusion between the carrier and the transferring overlay. Such primes, applied effectively in known manner, remain on the carrier as it is stripped off. Other coatings featuring one or more of the many known release agents or releasing binders, can be provided instead of or in addition to the cross-linked prime, but with such materials there is a chance that at least some will transfer with the cover material. This can be undesirable in a number of applications, especially those requiring lamination of the print to a security cover sheet; in the passports, driving licences, medical cards and security passes referred to above, for example. In general, therefore, the transferable overlay is placed directly onto the primed surface of the carrier base sheet. The overlay can be separate from the dyesheet used to prepare the image, although it is often convenient to have this packaged in a form which enables it to be used in the same apparatus as that which prints the image. To have the dyesheet ribbon and the overlay as separate entities, whether used in the same apparatus or not, enables a first printed image to be covered with overlay while a further image is being formed, thereby saving time. However, a preferred overlay is one which is incorporated into a dyesheet ribbon, suitably that used to form the image, comprising a substrate supporting different coloured dyecoats provided as discrete uniform print-size panels arranged in a repeated sequence along the ribbon, the carrier sheet of the overlay being provided by a part of the dyesheet substrate between repeated sequences of the dyecoat panels. Thus each sequence of print-size coloured dyecoats also has a further print-size panel of the thermally transferable overlay.

Although particularly useful for protecting D2T2 prints, the overlay of the invention may also be used in conjunction with silver halide prints.

The invention will be more readily understood from the following example.

EXAMPLE

The following coating solutions were prepared by mixing binder, uv-absorber and solvent (ethyl methyl ketone) in a high shear mixer for 45 minutes:

A: NEOCRYL B811 (12%) and UV-TITAN L181 (12%)

B: VYLON GK640 (16.5%) and UV-TITAN L181 (16.5%)

C: VYLON GK640 (22%) and UV-TITAN L530 (11%)

D: VYLON GK640 (22%) and UV-TITAN L230 (11%)

E: NEOCRYL B811 (24%) and P25 (5%)

F: NEOCRYL B811(19%) and CYASORB UV-24 (6%)

G: VYLON GK640 (20%)

H: NEOCRYL B811(20%)

NEOCRYL B811® is a poly methyl methacrylate of molecular weight 40,000 available from ICI.

VYLON GK640® is a polyester of molecular weight 20,000 available from Toyobo.

UV-TITAN L181, L230 and L530® are surface modified, ultrafine, titanium dioxides having crystal size (in nm) of 20, 17–33 and 30–35 respectively and specific surface area (in m2/g) of 60–75, 50–60 and 50–60 respectively, available from Kemira.

P25 is an ultrafine titanium dioxide having crystal size of 21 and specific surface area of 35–65 available from Degussa.

CYASORB UV-24® is a 2,2 dihydroxy-4-methoxybenzophenone available from Cytec Industries.

6 μm polyester film having a heat resistant back coat and a cross-linked subcoat was coated with the above formulations using a Meier bar to produce coatings having a wet thickness of approximately 12 μm which were dried for 1 minute at 110° C. to produce overlay samples.

Each sample was applied using the print head of a thermal transfer printer to a pre-printed test image on a thermal transfer printing receiver sheet ( ICI lmagedata CP15), the image including a black area having an Optical Density of 1.0 (as measured on a Macbeth TR1224 Densitometer) formed by superpositioning of yellow, magenta and cyan dyes. After peeling off the polyester film, the samples were subjected to the following tests for adhesion, image fading, barrier properties to dye transfer in the presence of a plasticiser and flashing (ie sharpness of the edges of the transferred overlay):

Adhesion

A strip of adhesive tape (3M "Magic Tape") is firmly adhered to the overlaid print and then removed. The area of overlay remaining adhered to the print is expressed as a percentage of the total area initially covered by the tape.

Image Fading

The overlaid black area is subjected to 3-day accelerated lightfastness testing at 50% RH in a Ci35 Weatherometer (Atlas Electric Devices Company) using a Xenon arc lamp giving a total energy of 390 J/m2 and an irradiance of 1.5 W/m2 measured at 420 nm. Image fading is expressed as the percentage reduction in optical density Barrier Property The overlaid black panel is placed in contact with a transparent PVC sheet containing approximately 24% di-(2-ethyl hexyl) phthalate plasticiser and placed under a load of 1.2 kg for 60 hours at a temperature of 50° C. After allowing cooling to ambient temperature, the PVC sheet is removed and the degree of transfer of print to dye is assessed by examining the PVC sheet against a white surface.

Flashing

The edges (particularly the trailing edge) are examined for jaggedness and/or non-adherence to the print.

The results of the tests are shown in the Table.

TABLE

| Sample | Adhesion | Fading | Barrier | Flashing |
|---|---|---|---|---|
| A | 100 | 20 | None | None |
| B | 100 | 21 | None | None |
| C | 100 | 23 | None | None |
| D | 100 | 22 | None | None |
| E | 100 | 56 | None | None |
| F | 100 | 18 | Severe | None |
| G | 100 | 45 | None | Severe |
| H | 100 | 47 | None | None |
| No Overlay | N/A | 49 | Severe | N/A |

What is claimed is:

1. A transfer foil comprising a carrier sheet and a thermally transferable overlay, the overlay comprising a transparent film of polymeric material having dispersed therein surface-stabilised titanium dioxide, wherein the titanium dioxide is stabilistd by coating the surface with alumina, silica or zirconia or mixtures thereof.

2. A transfer foil according to claim 1 in which the polymeric material has a Tg of between 50 and 200° C.

3. A transfer foil according to claim 1 in which the titanium dioxide is present in an amount of 1 to 400% on weight of binder resin.

4. A transfer foil according to claim 1 in which the titanium dioxide is present in an amount of 25% to 100%, on weight of binder resin.

5. A transfer foil according to claim 1 having a thickness of 0.1 to 25 $\mu$m.

6. A thermal transfer dye sheet ribbon comprising a substrate supporting different coloured dyecoats provided as discrete uniform print-size panels arranged in a repeated sequence along the ribbon, and a thermally transferable overlay comprising a trnsprarent film of poly meric materal having dispersed therein surface-stabilised titanium dioxide, positioned between each repeated sequence of the dyecoat panels, wherein the titanium dioxide is stabilised by coating the surface with alumina, silica or zirconia or mixtures thereof.

7. A thermal transfer dye sheet ribbon according to claim 6 in which the polymeric material has a Tg of between 50 and 200° C.

8. A thermal transfer dye sheet ribbon according to claim 6 in which the titanium dioxide is present in an amount of 1 to 400% on weight of binder resins.

9. A thermal transfer dye sheet ribbon according to claim 6 in which the titanium dioxide is present in an amount of 25% to 100%, on weight of binder resin.

10. A thermal transfer dye sheet ribbon according to claim 6 having a thickness of 0.1 to 25 $\mu$m.

* * * * *